US011067940B2

(12) United States Patent
Shimada

(10) Patent No.: US 11,067,940 B2
(45) Date of Patent: Jul. 20, 2021

(54) HOLDING MECHANISM FOR OPENING AND CLOSING DETECTION DEVICE AND IMAGE FORMING APPARATUS INCLUDING HOLDING MECHANISM

(71) Applicant: Toshihiro Shimada, Tokyo (JP)

(72) Inventor: Toshihiro Shimada, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/899,705

(22) Filed: Jun. 12, 2020

(65) Prior Publication Data

US 2021/0026288 A1 Jan. 28, 2021

(30) Foreign Application Priority Data

Jul. 23, 2019 (JP) ..... JP2019-135265

(51) Int. Cl.
*G03G 21/16* (2006.01)
*E05B 65/00* (2006.01)

(52) U.S. Cl.
CPC ..... *G03G 21/1619* (2013.01); *E05B 65/006* (2013.01); *G03G 21/1633* (2013.01)

(58) Field of Classification Search
CPC ..... G03G 21/1619; G03G 21/1633; E05B 65/006
See application file for complete search history.

(56) References Cited

U.S. PATENT DOCUMENTS

2002/0041775 A1* 4/2002 Ishii ..... G03G 21/1633 399/124
2011/0280608 A1 11/2011 Nomura et al.
2012/0012445 A1* 1/2012 Ohta ..... G03G 21/1633 200/50.12
2012/0294645 A1 11/2012 Shimada et al.
2014/0055016 A1 2/2014 Nishikawa et al.
2014/0167580 A1 6/2014 Funayama et al.
2014/0167587 A1 6/2014 Takenaka et al.
2014/0169828 A1 6/2014 Ohta et al.

FOREIGN PATENT DOCUMENTS

JP 63-014252 1/1988
JP 2011-047971 3/2011
JP 2013-109282 6/2013
JP 2017-116835 6/2017

* cited by examiner

*Primary Examiner* — Sandra Brase
(74) *Attorney, Agent, or Firm* — Harness, Dickey & Pierce, P.L.C.

(57) ABSTRACT

A holding mechanism for an opening and closing detection device includes a cam, a torsion coil spring, and a pressing member. The cam is rotatably supported in a housing. The torsion coil spring is attached to the cam or an inside of the housing and includes two ends extending in two directions. The pressing member biases one end of the two ends of the torsion coil spring and bring the other end of the two ends of the torsion coil spring into contact with the cam to apply a load to the torsion coil spring. The pressing member is attached to an outside of the housing while biasing the other end of the two ends of the torsion coil spring through an opening of the housing.

5 Claims, 4 Drawing Sheets

HOLDING MECHANISM FOR OPENING AND CLOSING DETECTION DEVICE AND IMAGE FORMING APPARATUS INCLUDING HOLDING MECHANISM

CROSS-REFERENCE TO RELATED APPLICATION

This patent application is based on and claims priority pursuant to 35 U.S.C. § 119(a) to Japanese Patent Application No. 2019-135265, filed on Jul. 23, 2019, in the Japan Patent Office, the entire disclosure of which is hereby incorporated by reference herein.

BACKGROUND

Technical Field

The present disclosure relates to a holding mechanism for an opening and closing detection device, and an image forming apparatus including the holding mechanism.

Description of the Related Art

An image forming apparatus has a configuration in which a cover member can be opened and closed and an image forming unit and a sheet conveyance unit can be accessed for toner replacement and paper jam processing. Since an image forming apparatus accommodates a high-voltage portion and rotating bodies such as gears and motors therein, the image forming apparatus generally includes an interlock switch that cuts off the supply of voltage when a cover member is opened.

SUMMARY

In an aspect of the present disclosure, a holding mechanism for an opening and closing detection device includes a cam, a torsion coil spring, and a pressing member. The cam is rotatably supported in a housing. The torsion coil spring is attached to the cam or an inside of the housing and includes two ends extending in two directions. The pressing member biases one end of the two ends of the torsion coil spring and bring the other end of the two ends of the torsion coil spring into contact with the cam to apply a load to the torsion coil spring. The pressing member is attached to an outside of the housing while biasing the other end of the two ends of the torsion coil spring through an opening of the housing.

In another aspect of the present disclosure, an image forming apparatus includes the holding mechanism, an interlock switch, and a cover. The interlock switch interrupts and passes a current. The cover is contactable with the cam when the cover is opened and closed. The cam turns on and off the interlock switch in conjunction with opening and closing of the cover.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 4A illustrates a state in which a switch of a microswitch is OFF and FIG. 4B illustrates a state in which the switch of the micro switch is ON;

Figure 1:
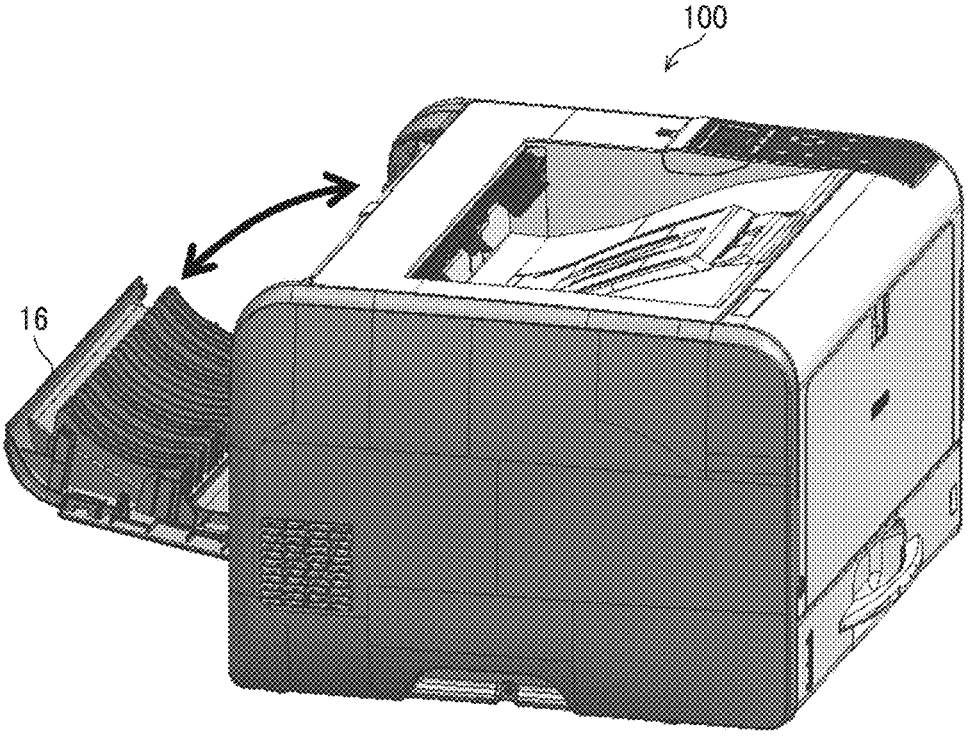
FIG. 1 is a perspective view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of embodiments of the present disclosure with reference to the drawings attached.

FIG. 1 is a perspective view of an image forming apparatus according to an embodiment of the present disclosure. As illustrated in FIG. 1, an image forming apparatus 100 according to the present embodiment includes a rear cover 16 as a cover. The rear cover 16 can be opened and closed to remove a recording sheet jammed in the image forming apparatus 100 or replace a fixing device 10 due to a failure or the like.

Figure 2:
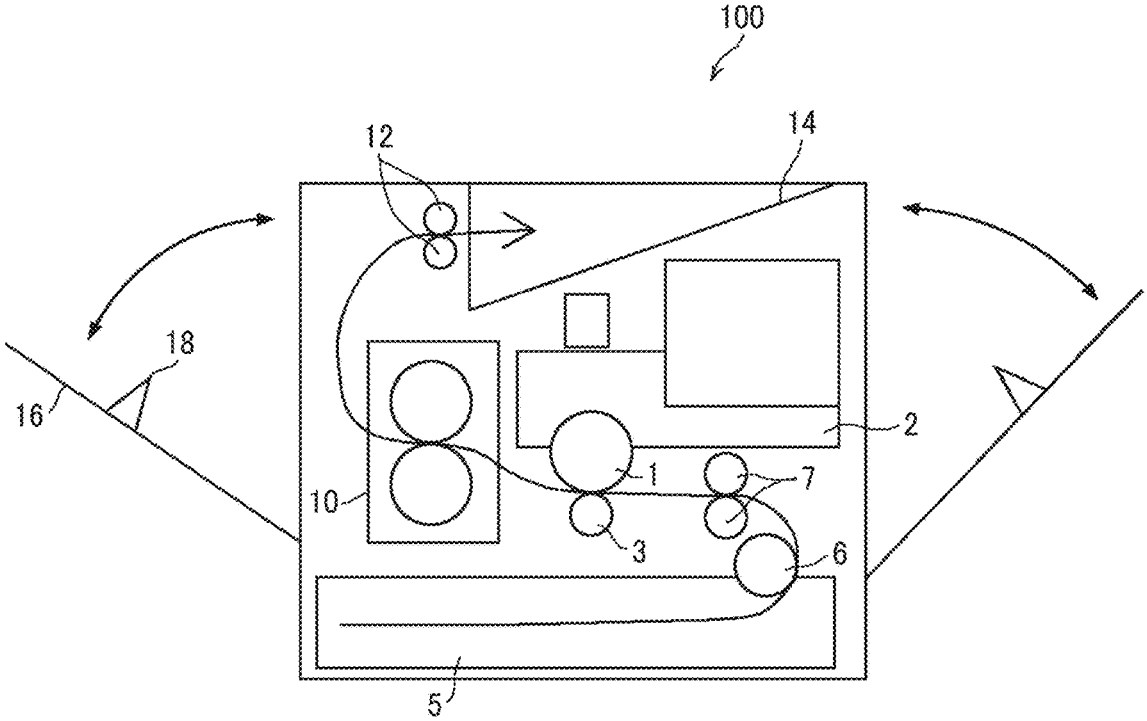
FIG. 2 is a schematic diagram illustrating an overall configuration of the image forming apparatus of FIG. 1.

FIG. 2 is a schematic diagram illustrating an overall configuration of the image forming apparatus of FIG. 1. The image forming apparatus 100 includes a photoconductor drum 1 as an image bearer. A developing device 2, a transfer roller 3, and the like are disposed around the photoconductor drum 1.

A sheet feeding cassette 5 is provided below the image forming apparatus 100, and a sheet feeding roller 6 that feeds a recording sheet, a pair of conveyance rollers 7, and the like are provided. The fixing device 10 is disposed on a lateral side of the photoconductor drum 1.

An image forming operation of the image forming apparatus 100 will be briefly described. When the image forming operation is started, the photoconductor drum 1 is driven to rotate in a clockwise direction as illustrated in FIG. 2, and a surface of the photoconductor drum 1 is uniformly charged to a predetermined polarity by a charger. Next, a laser writing device irradiates the photoconductor drum 1 with a laser beam as writing light to form an electrostatic latent image on the photoconductor drum 1. The developing device 2 applies toner to the electrostatic latent image to visualize the electrostatic latent image as a toner image.

On the other hand, a recording sheet is fed from the sheet feeding cassette 5 by the sheet feeding roller 6 and conveyed by the pair of conveyance rollers 7. Next, the recording sheet is sent out in synchronization with the visualized toner image, and the toner image is transferred onto the recording sheet at a transfer portion in which the photoconductor drum 1 and the transfer roller 3 face each other.

Subsequently, the toner image is fixed by the fixing device 10 to the recording sheet to which the toner image has been transferred, and the recording sheet is ejected and stacked on a sheet ejection tray 14 by a pair of sheet ejection rollers 12.

Figure 3:
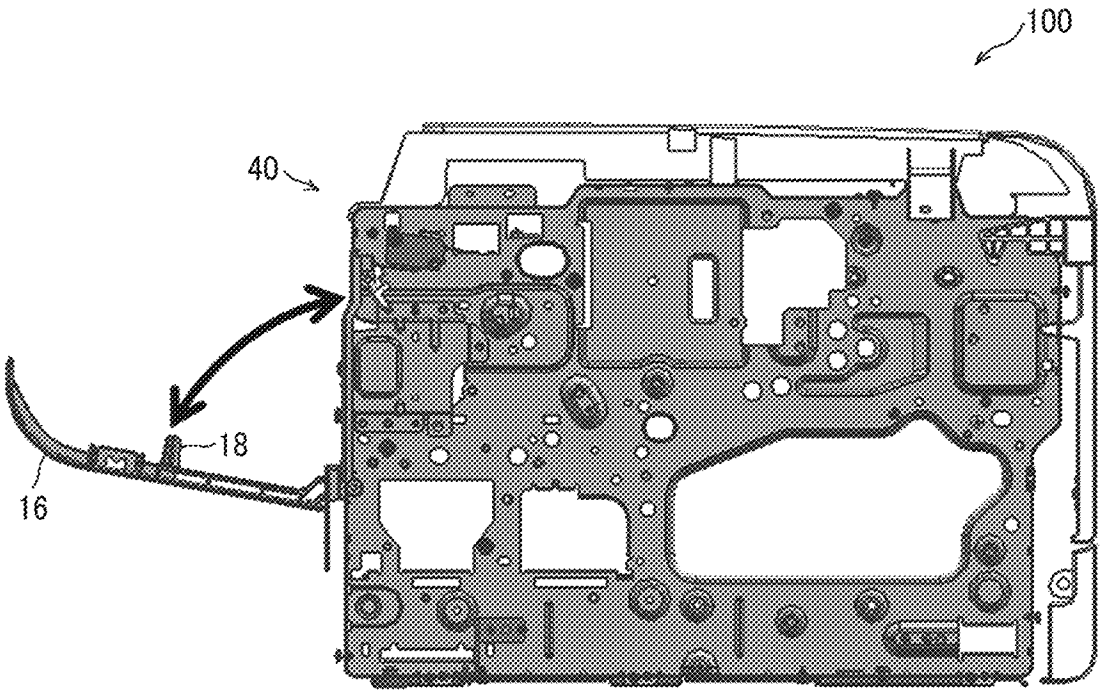
FIG. 3 is a schematic view of an opening and closing detection device provided in the image forming apparatus of FIG. 1.

FIG. 3 is a schematic view of an opening and closing detection device provided in the image forming apparatus of FIG. 1. As illustrated in FIG. 3, the image forming apparatus 100 includes an opening and closing detection device 40, which is a safety device (interlock) that interrupts the supply of voltage when the rear cover 16 is opened, for the safety of the user. The rear cover 16 is provided with a rear cover striker 18 acting on the opening and closing detection device 40.

Figure 4A:
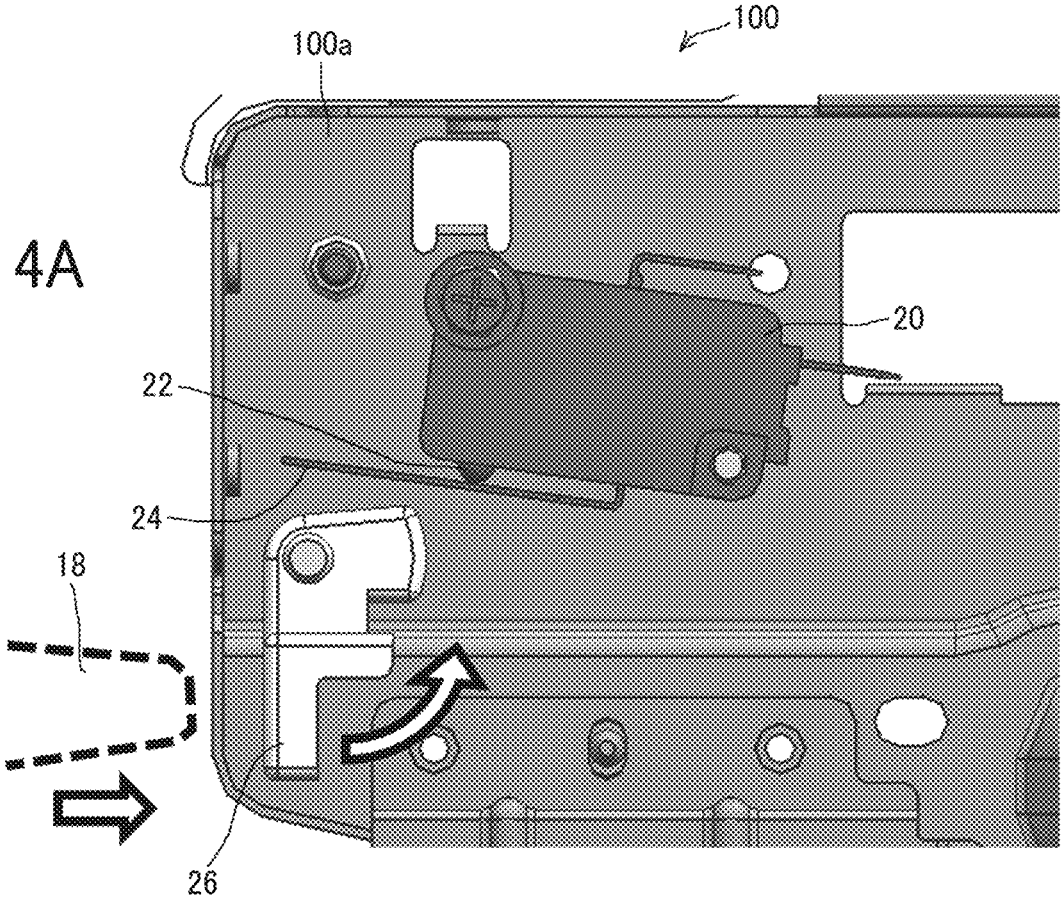
FIGS. 4A and 4B are schematic diagrams illustrating a basic configuration of the opening and closing detection device.
Figure 4B:
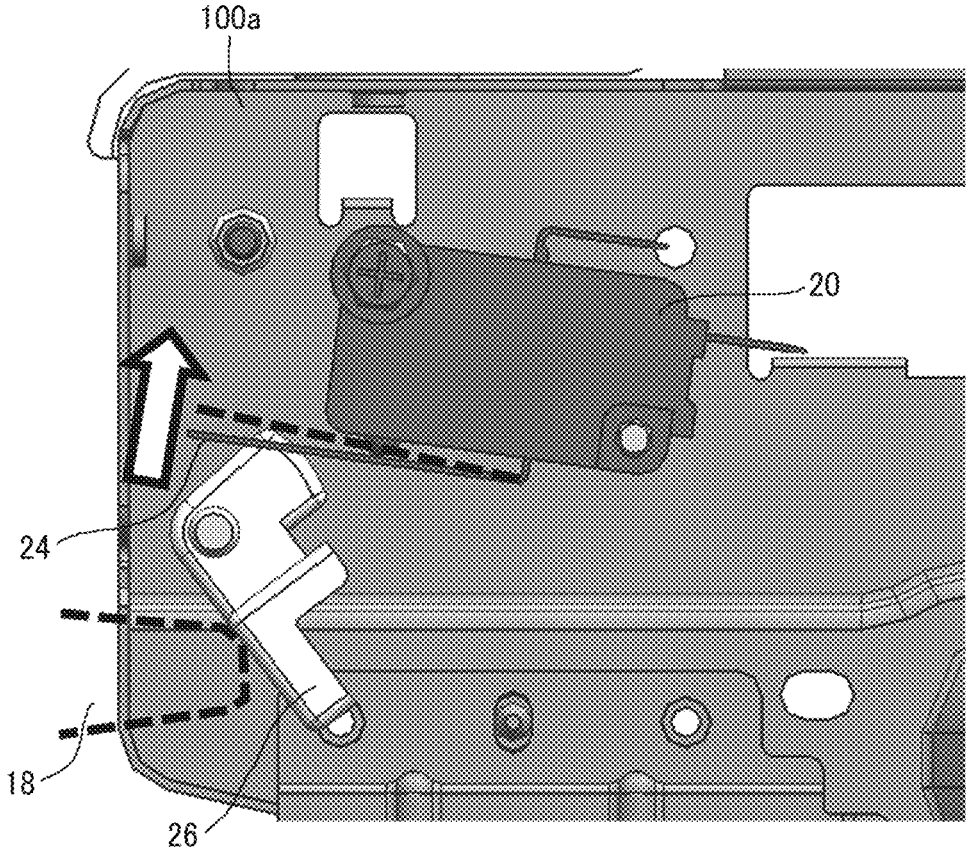

FIGS. 4A and 4B are schematic diagrams illustrating a basic configuration of the opening and closing detection device. FIG. 4A illustrates a state in which a switch of a micro switch is OFF, and FIG. 4B illustrates a state in which the switch of the micro switch is ON.

As illustrated in FIGS. 4A and 4B, the image forming apparatus 100 includes a micro switch 20, which is an interlock switch, and a cam 26 rotatably supported in a housing 100*a*.

The micro switch 20 has a switch 22 and a switch lever 24 that contacts the switch 22 to turn on and off current and voltage. When the micro switch 20 is turned off, all the electric devices that are energized through the micro switch 20 can be turned off. When the cam 26 is rotated in a counterclockwise direction in FIG. 4A, the cam 26 contacts the switch lever 24 of the micro switch 20 to turn on the switch 22.

With such a configuration, when the opened rear cover 16 is closed (FIG. 4A), the rear cover striker 18 (see FIG. 3) provided on the rear cover 16 urges the cam 26 to rotate counterclockwise (FIG. 4B). The rotated cam 26 turns on the switch 22.

On the other hand, when the rear cover 16 is opened from the closed state of FIG. 4B, the rear cover striker 18 is separated from the cam 26 (FIG. 4A). Accordingly, the cam 26 is also separated from the switch lever 24 to turn off the switch 22.

Here, in order to separate the cam 26 from the switch lever 24 and reliably turn off the switch 22, a biasing force to rotate the cam 26 clockwise is applied as follows.

Figure 5:
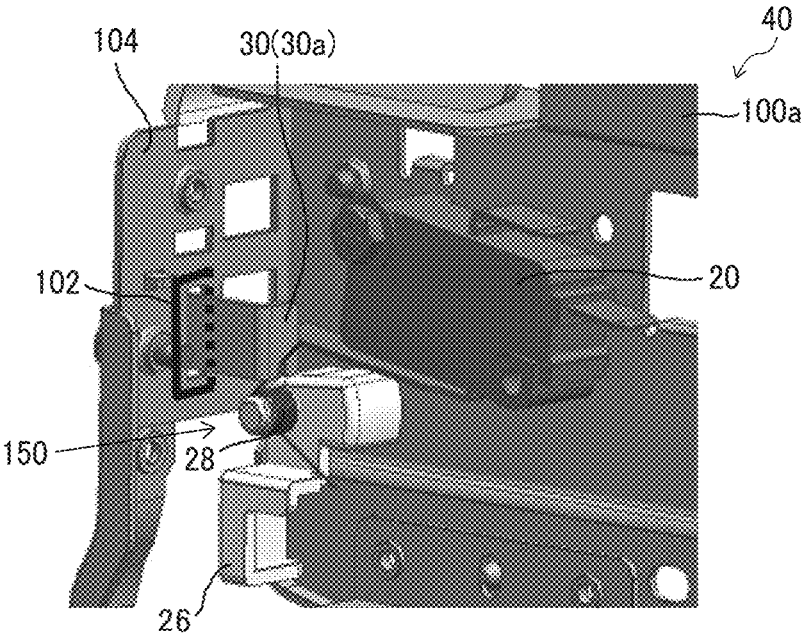
FIG. 5 is a perspective view of a holding mechanism of the opening and closing detection device according to an embodiment of the present disclosure.
Figure 6:
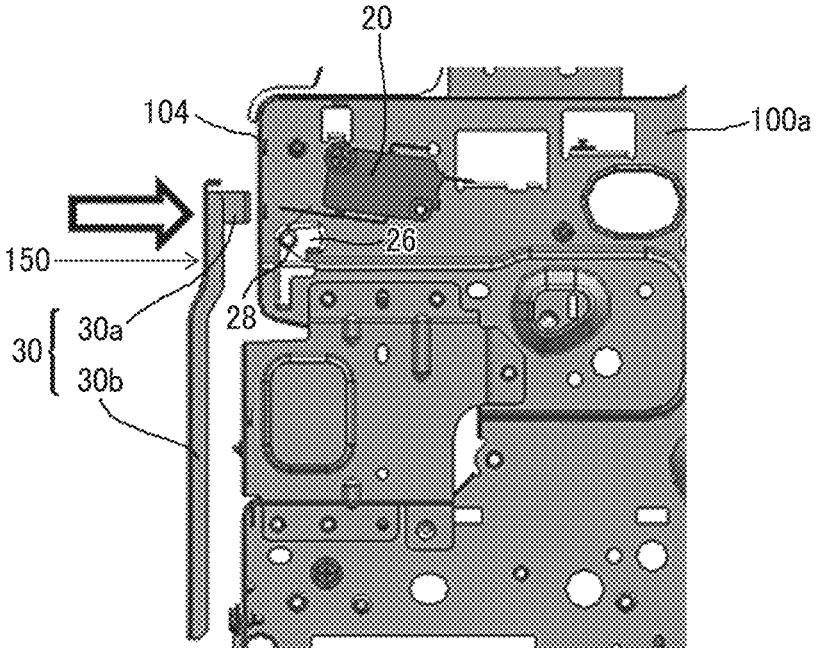
FIG. 6 is a plan view of the holding mechanism of the opening and closing detection device according to an embodiment of the present disclosure.

FIG. 5 is a perspective view of a holding mechanism of the opening and closing detection device according to an embodiment of the present disclosure. FIG. 6 is a plan view of the holding mechanism of the opening and closing detection device.

As illustrated in FIGS. 5 and 6, a holding mechanism 150 of the present embodiment includes a torsion coil spring 28 and a pressing member 30. The torsion coil spring 28 is attached to the cam 26 and has ends extending in two directions. The pressing member 30 applies a load to the torsion coil spring 28.

The pressing member 30 includes a biasing member 30*a* to bias one end of the torsion coil spring 28 and an attachment member 30*b* attached to an outside of the housing 100*a*. The biasing member 30*a* of the pressing member 30 biases one end of the torsion coil spring 28 through an opening 102 of the housing 100*a*, and brings the other end of the torsion coil spring 28 into contact with the cam 26 to apply the load to the torsion coil spring 28.

The torsion coil spring 28 to which the load is applied constantly biases the cam 26 in the clockwise direction. When the rear cover 16 is opened and the rear cover striker 18 is separated from the cam 26, the cam 26 is reliably separated from the switch lever 24 to turn off the switch 22 (see FIG. 4A).

In the holding mechanism 150 of the opening and closing detection device 40 of the present embodiment, the pressing member 30 is attached to the outside of the housing 100*a* while biasing the other end of the torsion coil spring 28 through the opening 102 of the housing 100*a*. That is, after the cam 26 and the torsion coil spring 28 are attached to the housing 100*a*, the pressing member 30 is attached to the housing 100*a* to apply a load to the torsion coil spring 28.

Therefore, the holding mechanism 150 of the present embodiment can assemble the torsion coil spring 28 without applying a load (without deforming the torsion coil spring). Further, when the pressing member 30 is attached, the biasing member 30*a* of the pressing member 30 can be hooked (inserted) to the opening 102 of the housing 100*a* to be temporarily placed (held). Since both hands of an assembly worker are available, the assembly worker can perform another job (for example, set a screw on a driver).

As described above, the holding mechanism 150 of the present embodiment has good workability (assemblability) and can improve the positional accuracy regardless of the degree of skill of the assembling worker.

As an advantageous configuration, an attachment surface 104 of the housing 100*a* to attach the pressing member 30 is desirably parallel or substantially parallel to the central axis of the torsion coil spring 28. When the pressing member 30 is attached to the housing 100*a*, a load can be naturally (smoothly) applied to the torsion coil spring 28.

The attachment surface 104 of the housing 100*a* may be formed separately from the housing 100*a*. The biasing member 30*a* may be provided with a slot into which one end of the torsion coil spring 28 can be inserted. The torsion coil spring 28 may be attached to an inside of the housing 100*a* instead of the cam 26.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A holding mechanism for an opening and closing detection device, the holding mechanism comprising:

a cam rotatably supported in a housing;

a torsion coil spring attached to the cam or an inside of the housing and including two ends extending in two directions; and a pressing member configured to bias one end of the two ends of the torsion coil spring and bring the other end of the two ends of the torsion coil spring into contact with the cam to apply a load to the torsion coil spring, wherein the pressing member is attached to an outside of the housing while biasing the other end of the two ends of the torsion coil spring through an opening of the housing.

2. The holding mechanism according to claim 1, wherein the pressing member is attached to the housing after the cam and the torsion coil spring are attached to the housing.

3. The holding mechanism according to claim 1, wherein a central axis of the torsion coil spring is parallel to an attachment surface of the housing to which the pressing member is attached.

4. The holding mechanism according to claim 1, wherein the pressing member includes a biasing member configured to bias the other end of the two ends of the torsion coil spring and an attachment member attached to the outside of the housing, and wherein the biasing member is inserted into the opening of the housing to be temporarily placed.

5. An image forming apparatus comprising:

the holding mechanism according to claim 1;

an interlock switch configured to interrupt and pass a current; and a cover configured to be contactable with the cam when the cover is opened and closed, wherein the cam is configured to turn on and off the interlock switch in conjunction with opening and closing of the cover.

* * * * *